United States Patent [19]

Szymanek

[11] Patent Number: 4,891,737

[45] Date of Patent: Jan. 2, 1990

[54] QUICK FIT DIFFUSER LENS APPARATUS

[75] Inventor: Donald D. Szymanek, Westlake, Calif.

[73] Assignee: Thin-Lite Corporation, Camarillo, Calif.

[21] Appl. No.: 282,033

[22] Filed: Dec. 9, 1988

[51] Int. Cl.[4] ..... F21S 3/00

[52] U.S. Cl. ..... 362/223; 362/260; 362/268; 362/331

[58] Field of Search ..... 362/217, 223, 224, 268, 362/326, 330, 331, 332, 374, 375, 455, 260, 147

[56] References Cited

U.S. PATENT DOCUMENTS

| | | | |
|---|---|---|---|
| 1,941,079 | 12/1933 | Exelmans | 362/224 |
| 2,246,320 | 6/1941 | Ralph | 362/309 |
| 3,210,875 | 10/1965 | Schwenkler | 40/129 |
| 4,088,881 | 5/1978 | Neer et al. | 240/7.25 |
| 4,157,584 | 6/1979 | Bhatt | 362/74 |
| 4,263,639 | 4/1981 | Schacht | 362/147 |
| 4,338,653 | 7/1982 | Marrero | 362/147 |
| 4,387,415 | 6/1983 | Domas | 362/74 |
| 4,530,039 | 7/1985 | Shin-Shi | 362/202 |
| 4,549,253 | 10/1985 | Totten | 362/364 |
| 4,573,111 | 2/1986 | Herst et al. | 362/217 |
| 4,574,338 | 3/1986 | Takasaki et al. | 362/278 |
| 4,580,200 | 4/1986 | Hess et al. | 362/147 |
| 4,625,267 | 11/1986 | Mikalonis | 362/224 |
| 4,667,275 | 5/1987 | Herst et al. | 362/217 |
| 4,670,823 | 6/1987 | Kochi et al. | 362/255 |
| 4,680,684 | 7/1987 | Wolber | 362/308 |

FOREIGN PATENT DOCUMENTS

| | | | |
|---|---|---|---|
| 718650 | 11/1954 | United Kingdom | 362/327 |
| 843627 | 8/1960 | United Kingdom | 362/223 |

*Primary Examiner*—Stephen F. Husar
*Assistant Examiner*—D. M. Cox
*Attorney, Agent, or Firm*—Fulwider, Patton, Rieber, Lee & Utecht

[57] ABSTRACT

A quick fit lens is provided including a lens body having a transparent face wall and formed with a channel disposed in confronting relationship with respect thereto for sliding receipt of a planar diffuser light panel.

6 Claims, 1 Drawing Sheet

QUICK FIT DIFFUSER LENS APPARATUS

BACKGROUND OF THE INVENTION

1. Field of the Invention

The present invention relates generally to light fixtures and, more particularly, to a lens body which receives a diffuser light panel for diffusing light.

2. Description of the Prior Art

It is well known that light fixtures may be used to illuminate darkened areas. In order to illuminate relatively large areas, as for instance the interior of a living area within a recreational vehicle, it is generally less expensive to merely increase the luminescence of existing fluorescent tubes to provide the increased luminosity desired, rather than adding additional lighting fixtures. However, with the increase in wattage and luminosity, there is an increased glare which can be irritating or distracting to the persons using the illuminated area. Furthermore, since there are fewer but brighter light sources, the increase luminosity may cause a harshness or sharpness in the shadows generated by the light. The shadows may provide additional distractions or otherwise interfere with one using the illuminated area.

As a result, those skilled in the art having generally used different ways to soften or diffuse the light emanating from light sources. One conventional solution is to glue or permanently fasten diffuser panels to a lens plate interposed between the light source and the area to be illuminated. However, affixation of the diffuser panel to the lens plate is time consuming, increases the cost of construction and often leaves unsightly and uneven glue lines along the opposite sides of the panel. In addition, if one subsequently wants to alter the spackling pattern of the diffuser panel or otherwise alter the degree of diffusion afforded thereby, replacement of the entire lens body is dictated. Indeed, even if one should be successful in removing such an affixed diffuser panel from the lens plate, there will typically be blemishes left upon the surfaces of the lens body which could cause unsightly or uneven diffusion of the light.

Hence, those concerned with construction and the use of light panels in conjunction with light fixtures, have long recognized the need for an improved quick fit lens construction which enables quick and easy installation and/or replacement of a removable diffuser panel. The present invention fulfills all of these needs.

SUMMARY OF THE INVENTION

Briefly, and in general terms, the present invention provides a new and improved quick fit lens construction for quickly and easily removing or adding diffuser panels in combination with a light fixture.

By way of example, and not necessarily by way of limitation, the quick fit lens construction of the present invention is characterized by a lens body which snappingly engages with a fluorescent light fixture, the lens body defining a channel within which a spackled panel may be slidingly inserted or removed therefrom.

More particularly, in one disclosed embodiment, the lens body may incorporate a light transmitting face member including a pair of resilient side walls extending outwardly away from the opposite sides thereof to terminate at the free sides in outwardly opening grooves which snappingly engage inturned flanges of a light fixture. Such side walls project, at their sides opposite the grooves, beyond the face wall to turn inwardly and form spaced apart, confronting retaining lips which cooperate with the face wall to define a receiving channel for sliding receipt of a diffuser panel formed with spackling thereon.

These and other objects and advantages of the invention will become apparent from the following more detailed description, when taken in conjunction with the accompanying drawings of illustrative embodiments.

DETAILED DESCRIPTION OF THE PREFERRED EMBODIMENT

Figure 1:
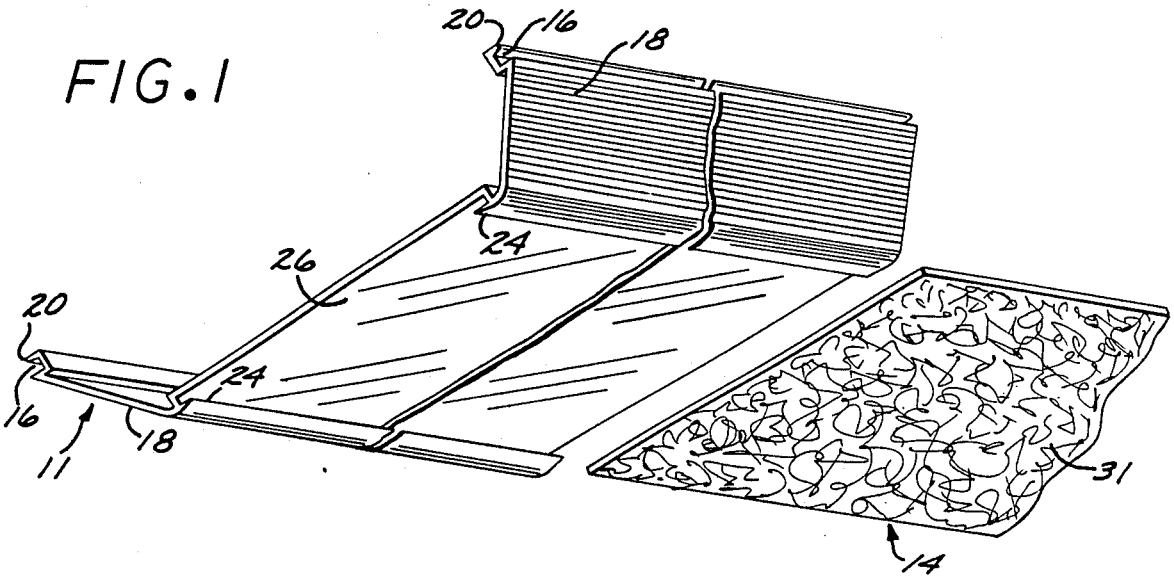
FIG. 1 is an exploded, fragmentary perspective view of a lens apparatus embodying the present invention.
Figure 2:
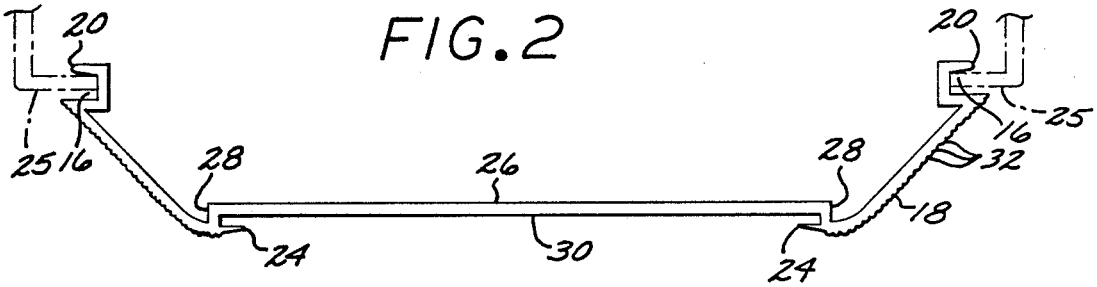
FIG. 2 is a left end view, in enlarged scale, of the lens apparatus shown in FIG. 1, with the diffuser panel removed therefrom.

Referring to the exemplary drawings for the purposes of illustration, the quick fit lens 11 of the present invention, is adapted to receive a planar light-transmitting diffuser panel, generally designated 14, (FIG. 1). As best shown in FIGS. 1 and 2, the quick fit lens body, generally designated 11, is of generally channel shaped and unitary construction, to form a transparent face wall 26 having a pair of resilient side walls 18 angling upwardly and away from the opposite sides thereof. Such side walls are formed at their free extremities with respective channel shaped rails defining outwardly opening grooves 16. At their opposite extremities such side walls project downwardly past the plane of the face wall and are formed with respective inturned retaining lips 24 spaced from the front face of the face wall 26 to cooperate therewith in forming a receiving channel 30 for sliding receipt of the diffuser panel 14.

Preferably the lens body 11 is constructed of translucent or transparent plastic with the face wall 26 being generally transparent. Preferably the side walls 18 angle upwardly and away from one another and then bend inwardly (FIG. 2) for a short distance to then turn upwardly to form respective back walls defining the back of the respective grooves 16 and then turn outwardly to form flanges 13 defining the top walls of the respective channel shaped grooves 16.

The grooves 16, with the side walls 18 in their relaxed condition, are spaced apart a distance equal to or slightly less than the distance between the retaining flanges 25 (FIG. 2) of the light fixture. Usually, since the lens body 11 is made of resilient, light transmitting material, these dimensions allow the lens body to adapt to various light fixture widths, and also provide a snapping engagement of the lens body upon the light housing.

Each side wall 18 extends diagonally inward from the respective grooves 16 towards each other and outward from the light source towards the illuminated area at an oblique angle. The respective side walls 18 are formed at their free extremities with the outwardly facing channels defining the respective grooves 16 and terminating in the respective outturned marginal retaining lips 20

Referring to FIGS. 1 and 2, the face wall 26 is set back from the bottom ends of the side walls 18 such that the front face thereof is spaced from the retaining lips 20 by vertical connecting spacers 28 so that such free panel and retaining lips 20 and the spacer walls 28 cooperate together to define a receiving channel 30 for sliding receipt of the diffuser light panel 14. In the preferred embodiment the face wall 26 is a generally transparent planar plastic sheet, extending between the side walls 18 and having opposite longitudinal edges turned in the same direction, e.g., bent towards the retaining lips 24, to form the connecting spacer legs 28 and join with the retaining lips 20.

Figure 3:
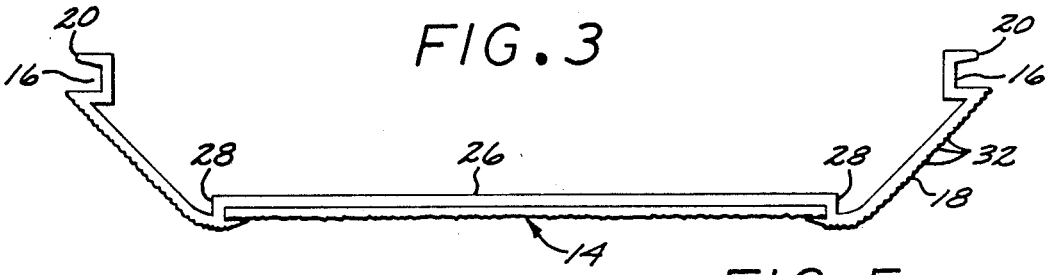
FIG. 3 is an end view similar to FIG. 2 but with the diffuser light panel in place.

As best shown in FIG. 3, the lens body 11 may be economically fabricated, as by extrusion molding to form a unitary piece. The planar diffuser light panel 14 may be fabricated separately with the desired diffusion pattern 31 formed on the bottom face in any desired manner. In the preferred embodiment this pattern is such as to give the appearance of cracked ice to thus afford an attractive appearance and provide the desired light diffusion. The panel 14 may be inserted within the channel 30 by sliding it longitudinally and parallelly between the face wall 26 and the retaining lips 20. In the preferred embodiment the lateral dimension between the confronting surfaces of the spacer legs 28 is slightly less than the width of the panel 14 to thus create a frictional fit therebetween serving to hold such panel in position. In addition, the retaining lips 20 are spaced from the front face of the wall 26 a distance slightly less than the thickness of the panel 14 to create a further frictional fit.

Figure 4:
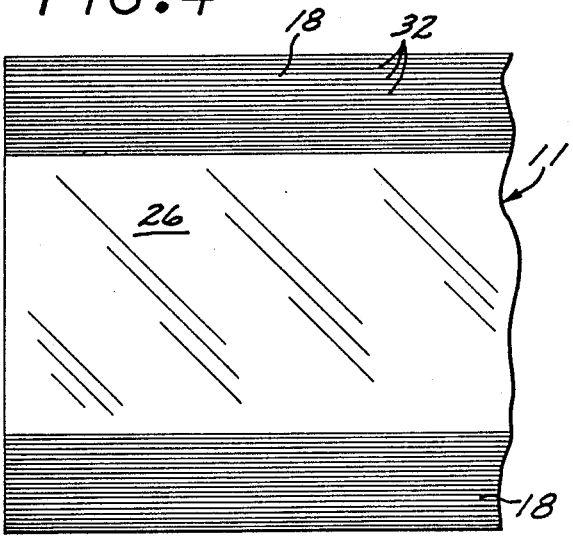
FIG. 4 is a fragmentary, bottom view, in reduced scale, of the lens apparatus shown in FIG. 2.

Referring now to FIG. 4, a plurality of substantially uniform longitudinal ridges 32 are formed parallelly down the longitudinal exterior portions of the side walls 18. These plural side wall ridges 32 create a uniform prismatic surface which softens the light emanating from the light source towards the area to be illuminated. This further diffuses the light emanating from the source and reduces the glare generated therefrom. In addition, by using uniform longitudinal ridges, the light is disbursed evenly to provide a uniform illumination of the area.

Figure 5:
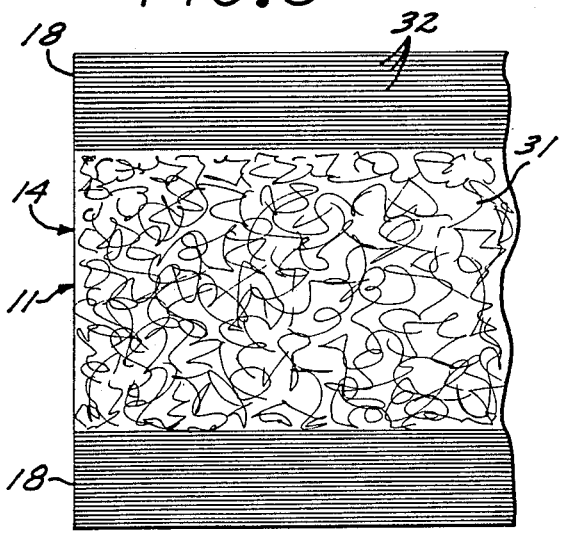
FIG. 5 is a fragmentary, bottom view, in reduced scale, of the lens apparatus shown in FIG. 3.

As best shown in FIG. 5, when the diffuser panel 14 is positioned within the channel 30, the prismatic ridges 32 of the side walls 18 and the diffuser panel 14 are interposed between the light source and the area to be illuminated, thus reducing the glare and softening the shadows generated by the light. Thus, the diffuser panel 14 serves to diffuse the light and present the aesthetic appearance of cracked ice, all without the gluing or other permanent affixation of the panel to the lens body or requiring compound molding steps required for one-piece lens construction, all without the expense attendant the separate step of adhering such panel to the lens body during the fabricating procedure. From the foregoing, the lens construction of the present invention allows for a quick and easy retention and removable interposition of a planar diffuser panel between the light source and the area to be illuminated.

It will be apparent from the foregoing that, while particular forms of the invention have been illustrated and described, various modifications can be made without departing from the spirit and scope of the invention. According, it is not intended that the invention be limited, except as by the appended claims.

What is claimed is:

1. Lens apparatus for use in combination with a fluorescent light fixture of the type including an elongated housing formed with oppositely disposed inturned lens flanges, said apparatus comprising:

a lens body of unitary construction including a transparent face wall formed with a front face, said lens body further including a pair of oppositely disposed, resilient side walls, formed along their free extremities with rails defining respective oppositely opening grooves for receiving such lens flanges and angling inwardly toward one another to join with the opposite sides of said face wall and then projecting beyond the front face thereof to turn inwardly and form inturned retaining lips spaced a predetermined distance from said front face to cooperate with said front face to form an open ended receiving channel; and a diffuser panel sized to be removably received and held within said receiving channel and including diffuser means for diffusing light projecting therethrough whereby said lens body may be fabricated to form said receiving channel and said diffuser panel slid thereonto, and said side walls may be flexed such that said free sides may be drawn toward one another to clear said lens flanges such that said lens flanges may be received in the respective grooves.

2. Lens apparatus according to claim 1 wherein:

said diffuser panel is of a selected thickness; and said retaining lips are spaced from the face of said face wall a distance less than said selected thickness to cooperate in forming a friction fit for said diffuser panel.

3. Lens apparatus according to claim 1 wherein:

said body includes connector legs defining the opposite sides of said receiving channel and spaced apart a distance less than said selected width to cooperate with said diffuser panel in forming a friction fit.

4. Lens apparatus according to claim 1 wherein:

said diffuser means includes refraction means simulating cracked ice.

5. The apparatus as set forth in claim 1, wherein:

said rails are formed by folding the respective side walls inwardly and then outwardly to form a pair of outward facing U-shaped channels defining the respective grooves.

6. The apparatus as set forth in claim 1, wherein:

said side walls include plural longitudinal, parallel ridges formed therein.

* * * * *